US011759381B2

(12) United States Patent
Huber et al.

(10) Patent No.: US 11,759,381 B2
(45) Date of Patent: Sep. 19, 2023

(54) METHOD AND APPARATUS FOR TABLE ACCESSORY DETECTION

(71) Applicant: Baxter Medical Systems GmbH + Co. KG, Saalfeld (DE)

(72) Inventors: Andreas Huber, Munich (DE); Felix Jochen Hempel, Munich (DE); Timotheus Bachinger-Colling, Munich (DE)

(73) Assignee: Baxter Medical Systems GmbH + Co. KG, Saalfeld (DE)

( * ) Notice: Subject to any disclaimer, the term of this patent is extended or adjusted under 35 U.S.C. 154(b) by 305 days.

(21) Appl. No.: 17/114,675

(22) Filed: Dec. 8, 2020

(65) Prior Publication Data

US 2021/0169721 A1 Jun. 10, 2021

Related U.S. Application Data

(60) Provisional application No. 62/945,259, filed on Dec. 9, 2019.

(51) Int. Cl.

| | |
|---|---|
| ***A61G 7/05*** | (2006.01) |
| ***A61G 7/07*** | (2006.01) |
| ***A61G 7/075*** | (2006.01) |

(52) U.S. Cl.

CPC ..... *A61G 7/0524* (2016.11); *A61G 7/072* (2013.01); *A61G 7/0755* (2013.01); *A61G 2203/10* (2013.01); *A61G 2203/30* (2013.01); *A61G 2203/70* (2013.01); *A61G 2205/60* (2013.01)

(58) Field of Classification Search

CPC .... A61G 7/0524; A61G 7/072; A61G 7/0755; A61G 2203/10; A61G 2203/30; A61G 2203/70; A61G 2205/60; A61G 7/00; A61G 7/05

See application file for complete search history.

(56) References Cited

U.S. PATENT DOCUMENTS

| | | | | |
|---|---|---|---|---|
| 2017/0172838 | A1* | 6/2017 | Brosnan | A61H 9/0078 |
| 2018/0344559 | A1 | 12/2018 | Hoel et al. | |
| 2019/0060149 | A1 | 2/2019 | Patmore et al. | |
| 2019/0262204 | A1 | 8/2019 | Hertz et al. | |
| 2020/0306129 | A1* | 10/2020 | Franklin | A61G 7/0503 |

FOREIGN PATENT DOCUMENTS

| | | | |
|---|---|---|---|
| EP | 3182947 | B1 | 5/2019 |

* cited by examiner

*Primary Examiner* — Fredrick C Conley
(74) *Attorney, Agent, or Firm* — Price Heneveld LLP

(57) ABSTRACT

An accessory detection apparatus for a modular medical device includes a support portion and at least one support accessory in connection with the support portion via a connection interface. The connection interface is configured to support the at least one support accessory extending from the support portion. The accessory detection apparatus includes at least one detection device in connection with a first portion of the connection interface and at least one identifier element in connection with a second portion of the connection interface. The apparatus further includes a controller in communication with the at least one detection device. The controller is configured to process at least one signal communicated from the at least one detection device and detect an identifier of at least one support accessory in response to the at least one signal.

18 Claims, 4 Drawing Sheets

METHOD AND APPARATUS FOR TABLE ACCESSORY DETECTION

CROSS-REFERENCE TO RELATED APPLICATIONS

This application claims priority under 35 U.S.C. § 119(e) and the benefit of U.S. Provisional Application No. 62/945,259 entitled METHOD AND APPARATUS FOR TABLE ACCESSORY DETECTION, filed on Dec. 9, 2019, by Andreas Huber, et al., the entire disclosure of which is incorporated herein by reference.

TECHNOLOGICAL FIELD

The disclosure relates to an accessory detection apparatus and, more particularly, to a detection apparatus for a medical support device configured to identify a connected accessory of a plurality of interchangeable accessories.

BACKGROUND

Modern devices, particularly in the medical field, are implemented in a wide variety of specialized apparatuses and tools that may be specifically designed to suit a desired application. Many such devices may incorporate interchangeable components that may be challenging to track and utilize in automated control systems. The disclosure provides for a detection apparatus that may be implemented to detect one or more interchangeable accessories while maintaining a robust design well suited to medical applications.

SUMMARY

In at least one aspect, the disclosure provides for an accessory detection apparatus. The accessory detection apparatus may be implemented in combination with a medical support device. The medical support device may include a support portion and at least one support accessory in connection with the support portion via a connection interface. The connection interface may be configured to support the at least one support accessory extending from the support portion. The accessory detection apparatus may comprise at least one detection device in connection with a first portion of the connection interface and at least one identifier element in connection with a second portion of the connection interface. A controller may be in communication with the at least one detection device of the accessory detection apparatus. The controller may be configured to process at least one signal communicated from the at least one detection device. The controller may further be configured to detect an identifier of the at least one support accessory in connection with the medical support device in response to the at least one signal from the at least one detection device.

These and other features, advantages, and objects of the present device will be further understood and appreciated by those skilled in the art upon studying the following specification, claims, and appended drawings.

DETAILED DESCRIPTION OF EMBODIMENTS

Figure 1:
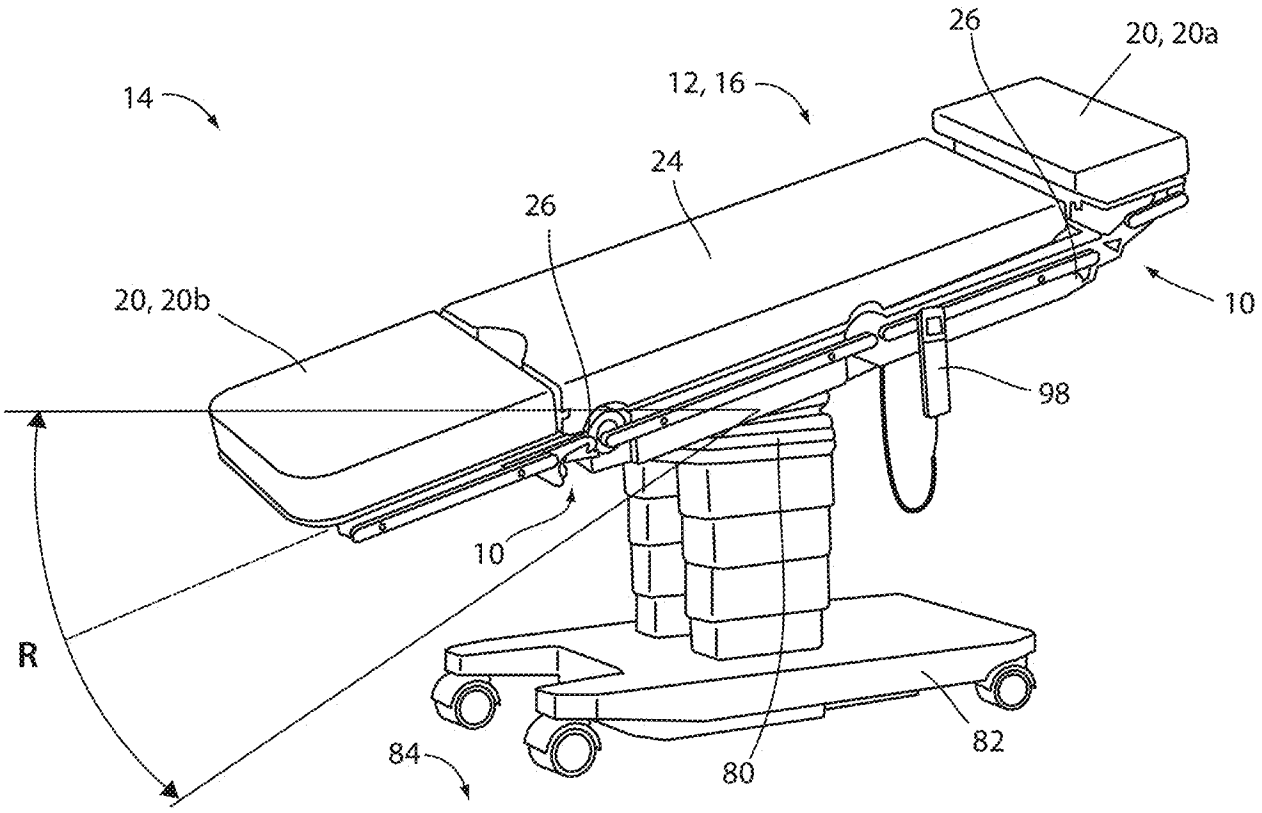
FIG. 1 is a projected view of a medical support device comprising a plurality of support accessories connected via a connection interface.

For purposes of description herein the terms "upper," "lower," "right," "left," "rear," "front," "vertical," "horizontal," and derivatives thereof shall relate to the device as oriented in FIG. 1. However, it is to be understood that the device may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Additionally, unless otherwise specified, it is to be understood that discussion of a particular feature or component extending in or along a given direction or the like does not mean that the feature or component follows a straight line or axis in such a direction or that it only extends in such direction or on such a plane without other directional components or deviations, unless otherwise specified.

As depicted in FIGS. 1-4, the disclosure provides for an accessory detection apparatus 10 that may be implemented in combination with a modular medical device 12. In some implementations, the modular medical device 12 may form a portion of a modular medical control system 14 that may be configured to detect and control a variety of devices that may be utilized in hospitals or medical treatment environments. For example, as depicted in FIG. 1, a medical support device 16 is depicted comprising a plurality of accessories 20. In operation, the control system 14 may be configured to utilize the accessory detection apparatus 10 to detect specific types, proportions, and/or various properties of the accessories 20 for a variety of types of accessories in order to customize or optimize the operation of the medical support device 16.

In the example depicted in FIGS. 1-4, the medical support device 16 may correspond to a patient support table or operating room table. In operation, the medical support device 16 may be configured to selectively connect to a plurality of accessories 20. In the instant example, the accessories 20 may correspond to patient support accessories, which may include a head support accessory 20*a*, a leg support accessory 20*b*, and a variety of additional accessories that may be connected to the medical support device 16. Each of the accessories 20 may be mechanically coupled to a central support portion 24 of the support device 16 via a connection interface 26. The connection interface 26 may comprise a plurality of mating components, as demonstrated in FIGS. 2-4.

In some implementations, the accessory detection apparatus 10 may be incorporated as a portion of the connection interface 26. In this configuration, the accessory detection apparatus 10 may be operable to detect an identifier indicating a type, model, or specific serial number of the accessory 20 without requiring a hardwired connection. Accordingly, a controller of the system 14 may be configured to identify one or more operating characteristics (e.g., proportions, dimensions, operating parameters, motion characteristics, control inputs, communication protocols, electrical requirements, specific connecting accessories (e.g., lights, data connections, specialty tools, etc.)) of the accessories 20, such that a control scheme for the accessories 20 may be automatically accessed and implemented by the control system 14. In this way, the accessory detection apparatus 10 may be implemented to improve the operation of the modular medical device 12.

Figure 2:
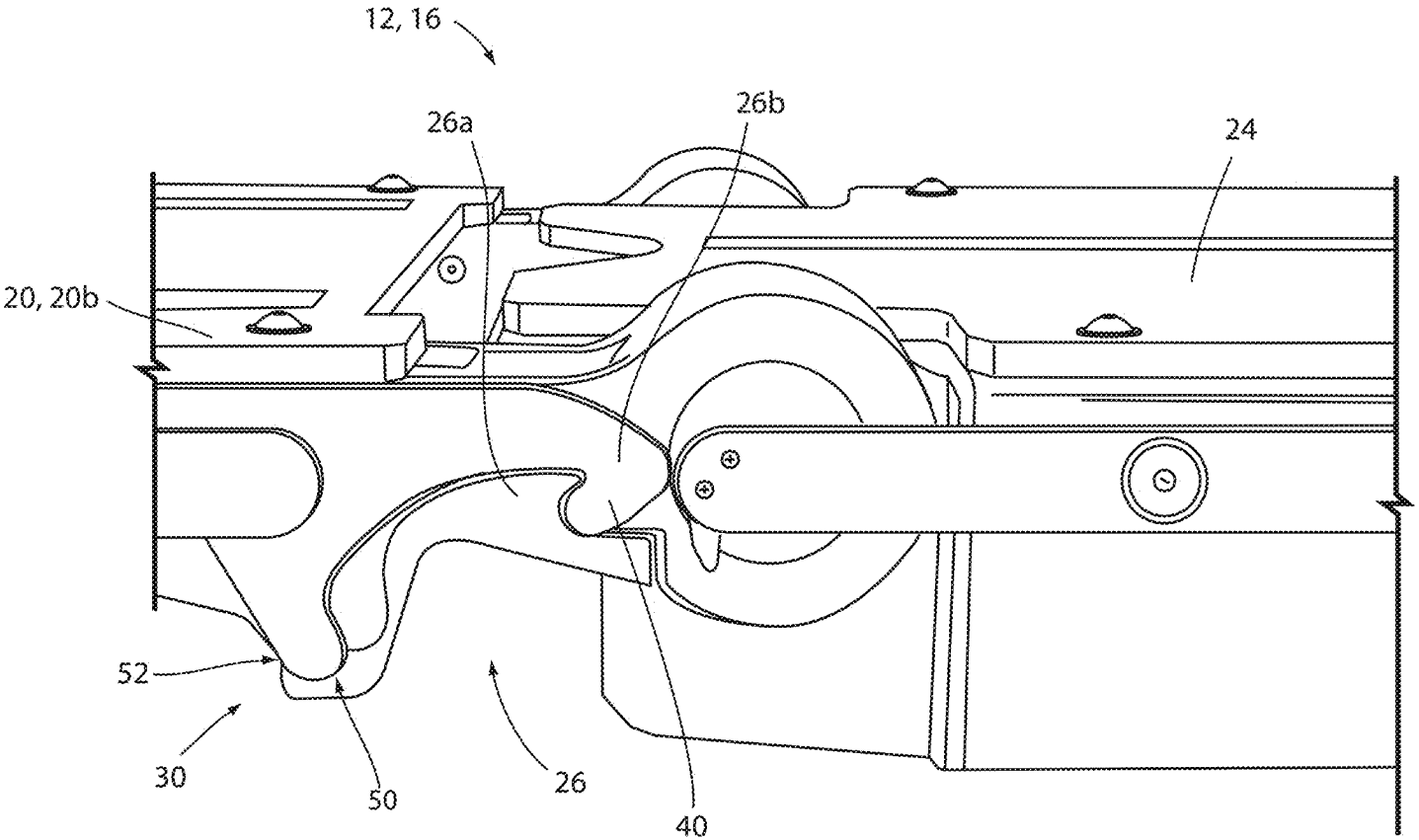
FIG. 2 is a projected view of a connection interface comprising an accessory detection apparatus.
Figure 3:
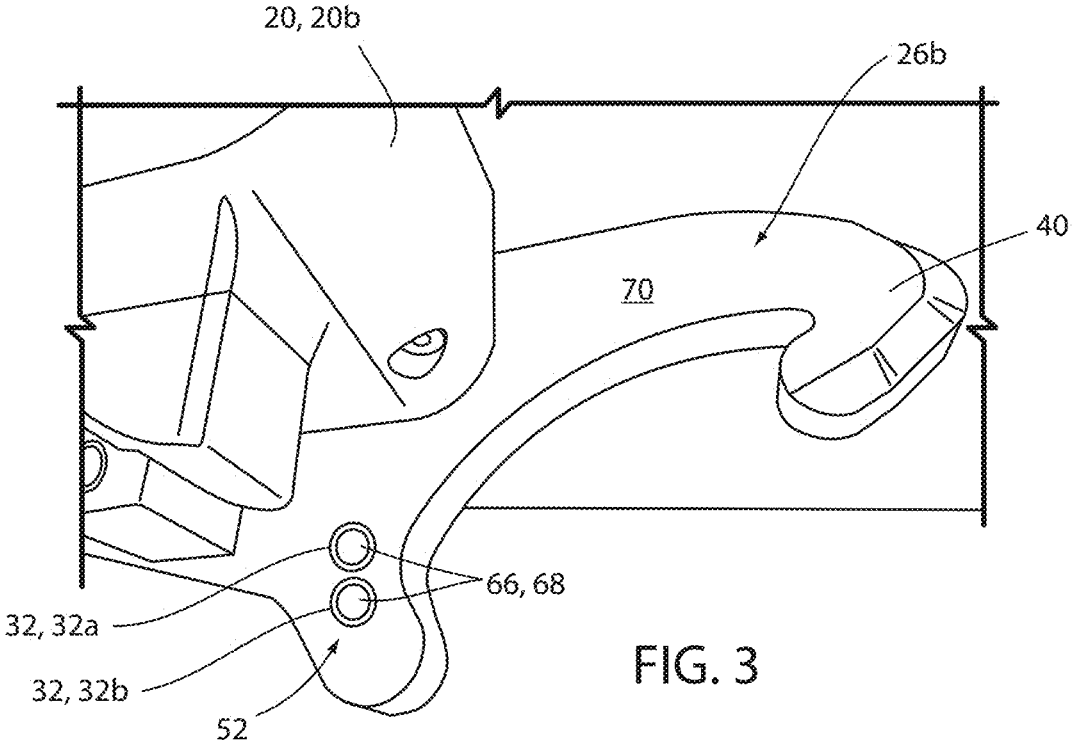
FIG. 3 is a detailed view of a first mating portion of the connection interface depicted in FIG. 2.
Figure 4:
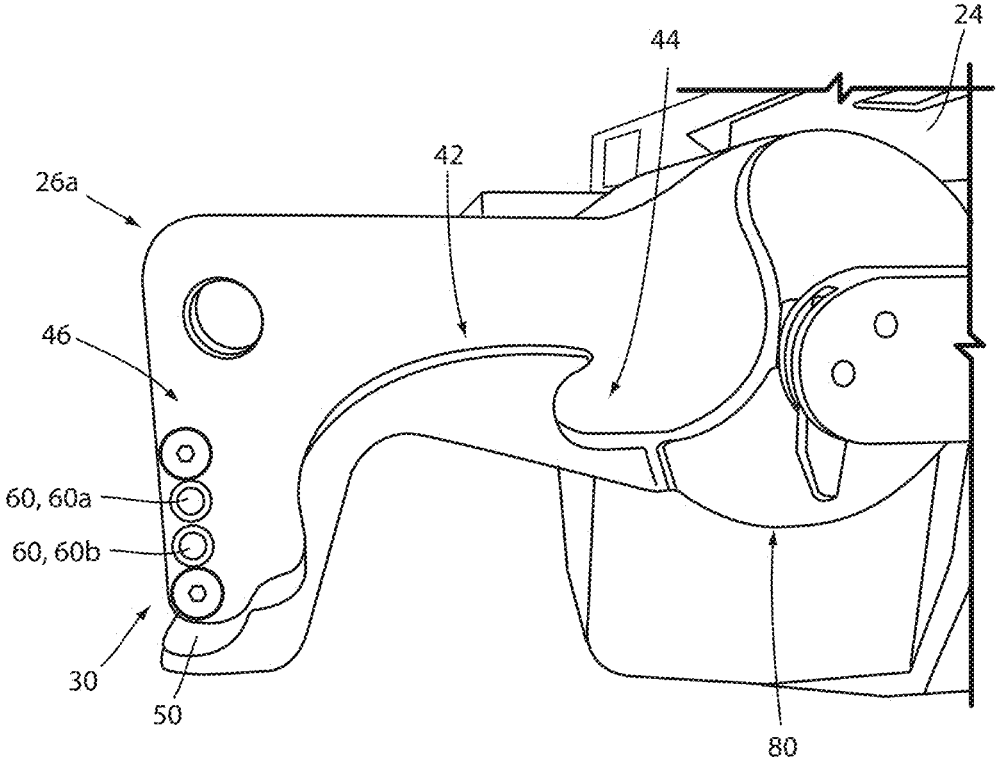
FIG. 4 is a detailed view of a second mating portion of the connection interface depicted in FIG. 2.

Referring now to FIGS. 2-4, detailed views of examples of the connection interface 26 are demonstrated in further detail. Though specific mating configurations of the connection interface 26 are depicted in the figures, the invention shall not be considered limited to the specific examples discussed herein. As previously discussed, the accessory detection apparatus 10 may be incorporated as a portion of the connection interface 26. For example, at least one detection device 30 may be in connection with a first portion 26*a* of the connection interface 26, and an identifier element 32 of the accessory detection apparatus 10 may be in connection with a second portion 26*b* of the connection interface 26. In this configuration, the detection device 30 may be oriented to align with the at least one identifier element 32 in response to the first portion 26*a* and the second portion 26*b* of the connection interface 26 arranged in a mating, aligned orientation.

The first portion 26*a* of the connection interface 26 may be in connection with the central support portion 24 of the support device 16. In this configuration, a controller of the medical control system 14 may be coupled to and/or in communication with the detection device 30. Accordingly, the detection device 30 may correspond to an actively controlled device configured to detect one or more properties of the at least one identifier element 32. Additionally, the second portion 26*b* of the connection interface 26 may be in connection with each of the accessories 20, and the identifier elements may correspond to passive devices or structure that may be wirelessly charged, activated, and/or detected by the detection device 30. In this configuration, the detection device 30 in connection with the first portion 26*a* may be configured to detect one or more properties of the support a accessories 20 based on a configuration or presence of the at least one identifier element 32, which may be disposed in the second portion 26*b*.

In the exemplary implementations depicted in the appended figures, the second portion 26*b* may correspond to a hook-like appendage 40 extending from the accessory 20 along an engaging profile 42. The engaging profile 42 may be configured to form a locking engagement with a complementary surface of the first portion 26*a* of the connection interface 26. In operation, the hook-like appendage 40 of the second portion 26*b* may be configured to engage a complementary receiving channel 44 formed in the first portion 26*a*. The engaging profile 42 may extend from the receiving channel 44 to a distal end portion 46 of the second portion 26*b*. Proximate to the distal end portion 46, the engaging profile 42 of the first portion 26*a* may form a receiving notch 50 configured to receive a retaining arm 52 of the second portion 26*b*. In this configuration, the hook-like appendage 40 of the second portion 26*b* may be configured to engage the complementary receiving channel 44 of the first portion 26*a* and interlock the second portion 26*b* to the first portion 26*a* via the interface between the receiving notch 50 of the first portion and the retaining arm 52 of the second portion 26*b*. Though discussed in detail in the specific mating configuration depicted in FIGS. 2-4, the accessory detection apparatus 10 may be implemented in a variety of mating assemblies and configurations without departing from the spirit of the disclosure.

As previously discussed, the accessory detection apparatus 10 may be incorporated in one or more portions of the connection interface 26. In the exemplary embodiment, the at least one identifier element 32 comprises a plurality of identifier elements 32, which may correspond to a first identifier element 32*a*, a second identifier element 32*b*, etc. Each of the identifier elements 32 may be disposed in one or more apertures or openings formed in the second portion 26*b* of the connection interface 26. As depicted, the first and second identifier elements 32*a*, 32*b* are disposed in apertures formed proximate to the retaining arm 52. Each of the identifier elements 32 may be aligned with a corresponding magnetic sensor 60 of the detection device 30. For example, a first magnetic sensor 60*a* may be aligned with the first identifier element 32*a*, and a second magnetic sensor 60*b* may be aligned with the second identifier element 32*b* in response to the mating portions of the connection interface 26 connected in the interlocking configuration depicted in FIG. 2. In this configuration, each of the magnetic sensors 60 may be configured to identify one or more properties or conditions of the corresponding identifier elements 32 aligned therewith.

Each of the identifier elements 32 may correspond to magnetic inserts 66 that may be connected to the second portion 26*b* of the connection interface 26 in a variety of ways. In an exemplary implementation, the magnetic inserts 66 are incorporated in apertures 68 formed in a surface directed toward a mating interface 70 between the first portion 26*a* and the second portion 26*b*. In this configuration, the magnetic inserts 66 may be aligned with each of the magnetic sensors 60 over the mating interface 70, such that the controller of the medical control system 14 may be configured to detect one or more properties of the magnetic inserts 66. As discussed in reference to the magnetic inserts 66, the identifier elements 32 may also or alternatively correspond to one or more ferrous or non-ferrous materials (e.g., ferrous metal inserts, non-ferrous plastic or polymer plugs). In such configurations, the controller of the medical control system 14 may be configured to detect the presence of one or more ferrous materials located proximate to the magnetic sensors 60. The controller of the medical control system 14 is further discussed with reference to FIG. 5.

The magnetic sensors 60, as discussed herein, may correspond to any form of magnetic detection device. In an exemplary embodiment, the magnetic sensors 60 may be implemented as Hall-effect sensors or similar sensors that may be operable to detect variations in a direction, strength, and/or density of a magnetic field. In operation, the magnetic sensors 60 may be configured to detect at least a presence of a magnetic field exceeding a predetermined threshold for a corresponding identifier element 32 arranged in a complementary portion of the connection interface 26. In some implementations, one or more of the magnetic sensors 60 may be configured to identify a direction or orientation of a magnetic field of a corresponding magnetic insert 66. For example, the first magnetic sensor 60*a* may be configured to detect if a north pole of the first identifier element 32*a* is directed toward or away from the mating interface 70. Finally, in some implementations, one or more of the magnetic sensors 60 may be configured to detect a density or strength of a magnetic field of the corresponding identifier element 32. Accordingly, the controller of the control system 14 may be configured to identify a variety of unique properties of each of the identifier elements 32 based on one or more signals communicated via the at least one magnetic sensor 60.

In some examples, the magnetic sensors 60 may be configured to identify the strength or density of the magnetic field of the corresponding identifier element 32 aligned therewith via the connection interface 26. Based on the strength or density of the magnetic field, one or more of the magnetic sensors 60 may communicate a corresponding signal strength to the controller of the medical control system 14. Based on the signal strength or a corresponding value communicated from the at least one magnetic sensor 60, the controller may determine if a strength or density of the magnetic field of one or more of the identifier elements 32 exceeds one or more thresholds. Accordingly, each of the identifier elements 32 may be scanned by the corresponding detection devices 30 in order to identify a coded sequence of identifiers or characters that may identify a type, a specific serial number, a proportion, or various additional information of the accessory 20 connected to the modular medical device 12.

For example, the controller of the medical control system 14 may be configured to determine if a strength of the magnetic field of the first identifier element 32*a* exceeds a first threshold value communicated from the first magnetic sensor 60*a*. Similarly, the controller may be configured to determine if the strength or density of the magnetic field of the first identifier element 32*a* exceeds a second threshold value communicated via the first magnetic sensor 60*a*. The second threshold value may correspond to a higher or increased level of strength of the magnetic field of the first identifier element 32*a*. In this way, the controller of the control system 14 may be configured to identify whether one or more of the identifier elements 32 exceeds one or more threshold strengths based on the strength or intensity of the magnetic insert 66. Accordingly, the controller of the control system 14 may further be operable to distinguish among the magnetic inserts 66 implemented for one or more of the identifier elements 32 based on a magnetic field intensity or strength of the corresponding magnetic material or magnet.

As discussed in reference to a first threshold and a second threshold, it may be understood that the magnetic field strength of each of the magnetic inserts 66 may be determined or reported by the magnetic sensors 60 at various levels of accuracy and/or resolution. Accordingly, the determination by the controller of the magnetic strength of the one or more magnetic inserts 66 may be compared to multiple threshold values in order to identify the type, operation, and/or various properties of the accessories 20. For example, the controller of the control system 14 may be configured to distinguish among a variety of the magnetic inserts 66 based on the magnetic field strengths exceeding a number of different threshold values. As the number of detectable threshold values of the magnetic field strength of the magnetic inserts 66 increases, so does the resolution or numeric base associated with each of the identifier elements 32 that may be communicated to the controller of the medical control system 14.

For example, if a controller is operable to determine if the magnetic field of each of the magnetic inserts 66 exceeds five or more threshold values, the controller may be operable to identify eleven or more different states of each of the magnetic inserts 66. In such a system, the eleven different states may be based on the presence detection of the magnetic insert, each of the five threshold levels of the magnetic field of the magnetic insert 66, and the detected orientation or direction of the polarity of the magnetic field of the magnetic inserts 66, which essentially doubles the number of thresholds for detection. Accordingly, the disclosure may provide for a sophisticated solution that may identify information from each of the accessories 20 to the controller of the medical control system 14 via the magnetic sensors 60 in order to communicate a variety of information identifying or distinguishing each of the accessories 20 configured to connect to the modular medical device 12.

Though discussed generally in reference to two identifier elements 32 and corresponding magnetic sensors 60, the accessory detection apparatus 10 may comprise a variety of different configurations with one to ten or more identifier elements 32 and corresponding magnetic sensors 60. The number of identifier units may be changed to adjust a number of units or characters coded to an accessory 20. Additionally, the number of thresholds of magnetic strength of each of the identifier elements 32 that may be identified by the controller in combination with the corresponding direction of polarity of each of the identifier elements 32 may determine a base of each identifier or significant figure for a numeric positioning system (i.e., a base of a numbering system). In operation, the controller may be configured to decipher or identify an identification number, code, or serial number identifying the accessory 20 from each of the identifiers. By adjusting the number of identifier elements 32 and the numeric base of each of the identifier elements 32, the accessory detection apparatus 10 may be scaled or adjusted to provide the information to the controller from each accessory 20 that may be necessary to identify and control the modular medical device 12 based on the operating requirements or parameters of each of the accessories 20. Accordingly, the accessory detection apparatus 10 may be scaled or modified to suit a desired application without departing from the spirit of the disclosure.

Referring again to FIG. 1, in some implementations, the medical support device 16 may comprise an actuator assembly 80 that may be configured to adjust an orientation of the central support portion 24 and/or one or more of the connected accessories 20. However, due to the nature of the modular medical device 12 and the variations in the proportions and/or applications of the accessories 20, a range of motion "R" of the modular medical device 12 may vary based on the specific accessories 20 connected therewith. In order to assure that the range "R" of the actuator assembly 80 does not result in interference between or among the accessories 20, a support base 82, a floor 84, and/or additional portions of the modular medical device 12, the controller may access a table or database identifying kinematic parameters (e.g., the operating range) of the modular medical device 12 in connection with the identified accessories 20. In this way, the controller may automatically adjust the range "R" of the actuator assembly 80 based on control information. The kinematic parameters as discussed herein may correspond to a rotational range of motion, a translational range of motion, rate of motion, a power setting or associated force limit of an actuator of the actuator assembly 80, an intensity setting of a lighting device or accessory, etc. In some instances, the control information may include one or more operating routines, preconfigured positions, operating limits, communication parameters, etc. of the connected accessories 20.

Additionally, based on the identifier or code detected by the detection apparatus 10, the controller may access a table or database to identify various additional control information related to the connected accessory. The table or database may be accessed in a local memory or via a connected server or device in communication therewith. In this way, the controller of the system 14 may ensure proper operation of the system 14 and avoid interference between the device 12, its accessories 20, and/or its operating environment. In addition to the range of motion "R," various operating characteristics of the modular medical device 12 may be controlled based on the identifier or information communicated or detected by the accessory detection apparatus 10. Such characteristics, may include, but are not limited to, motion characteristics, control inputs, communication protocols, electrical requirements, specific connecting accessories (e.g., lights, data connections, specialty tools), and a variety of additional information that may be implemented to track the usage of or control the operation of each of the accessories 20 of the modular medical device 12.

Figure 5:
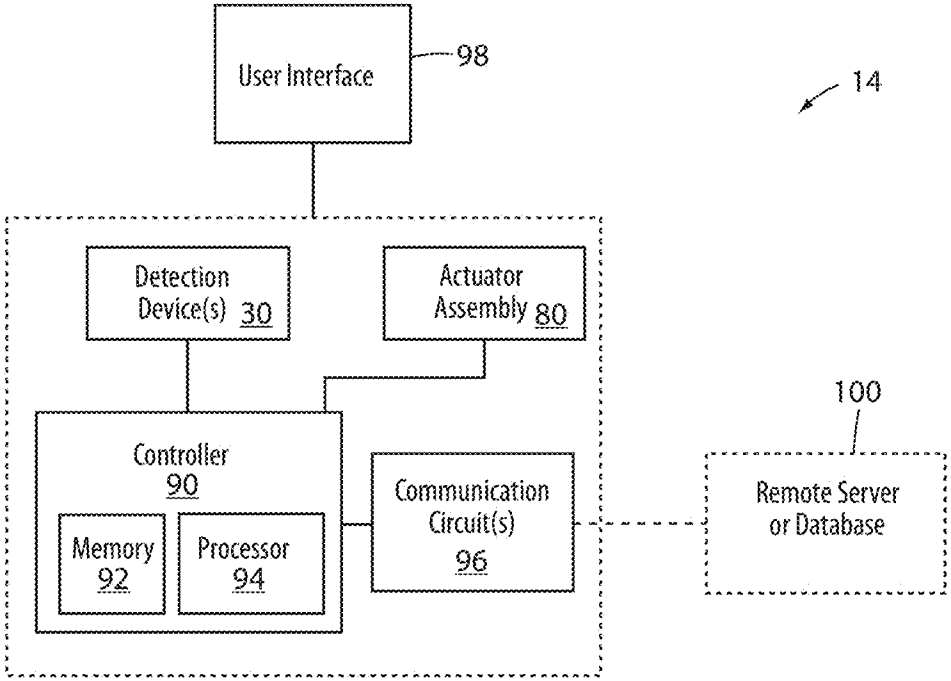
FIG. 5 is a block diagram of a controller of the accessory detection apparatus in communication with an actuator of the medical support device in accordance with the disclosure.

Referring to FIG. 5, a block diagram of a controller 90 of the medical control system 14 for the medical support device 16 is shown. As discussed herein, the medical support device 16 may correspond to a patient support table or operating room table configured to connect to at least one support accessory 20. Though discussed in reference to the support accessories 20, the modular medical device 12 may more generally be connected with one or more modular accessories 20, which may correspond to attachments or devices configured to provide a variety of utilities. In various implementations, the control system 14 may comprise the controller 90 in communication with the accessory detection apparatus 10. The controller 90 may include a memory 92 and a processor 94. The memory 92 may store computer-executable commands (e.g., routines) which are controlled by the processor 94. For example, the processor 94 may access the memory to identify a configuration for each of the accessories 20 in response to the identifier determined from the information captured via the detection device 30 of the accessory detection apparatus 10. According to various examples, the memory 92 may include a database of accessory configurations, operating characteristics, dimensions, operating ranges, weight limits, etc.

In some embodiments, the system 14 may further comprise one or more communication circuits 96, which may be in communication with the processor 94. The communication circuit 96 may be configured to communicate data and control information for operating the modular medical device 12, which may further comprise a user interface 98. The user interface 98 may comprise one or more input or operational elements configured to control the system 14, which may be configured to control the operation of the at least one actuator assembly 80 as previously discussed. The communication circuit 96 may further be in communication with additional devices or systems that may operate in combination with the system 14, particularly in a medical facility or operating room. The communication circuit 96 may be configured to communicate via various communication protocols. For example, communication protocols may correspond to a communication interface (e.g., Ethernet, serial peripheral interface (SPI), I2C protocol, controller area network (CAN), etc.) as well as various wireless communication protocols. For example, the communication circuit 96 may communicate via wireless protocols including, but not limited to, Bluetooth®, Wi-Fi (802.11a, b, g, n, etc.), ZigBee®, Z-Wave®, etc.

In some implementations, the controller 90 may further be operable to track or monitor the usage of the modular accessories 20. For example, in response to determining the identifier (e.g., serial number) of a connected modular accessory 20 based on information communicated from the accessory detection apparatus 10, the controller 90 may track a time of usage, type of usage, and/or any form of usage information that may be stored in the memory and/or a remote server or database 100, which may be in communication with the controller 90 via the communication circuit. In this way, the system 14 may be configured to track the usage of the modular accessories 20 and detect a timing for replacement, maintenance, sterilization, or various other periodic services related to the modular accessories 20.

The at least one actuator assembly 80 may comprise one or more motors or actuators that may be configured to adjust a position or orientation of the modular medical device 12 and one or more connected accessories 20. The actuator(s) of the actuator assembly 80 may include, but are not limited to, electric motors, servo motors, electric solenoids, pneumatic cylinders, hydraulic cylinders, etc. The actuator may be connected to the modular medical device 12 and/or modular accessories 20 via gears (e.g., pinion gears, racks, bevel gears, sector gears, etc.), levers, pulleys, or other mechanical linkages. The actuator assembly 80 may also act as a brake by applying a force or torque to prevent the transitioning of the modular medical device 12 and accessories 20.

In some aspects, the disclosure may provide for an accessory detection apparatus for a modular medical device. The detection device may correspond to a means for identifying a model indication, serial number, or various information identifying one or more properties of an accessory configured to connect to the modular medical device. The means for identifying the model indication may correspond to a sensory device that may include a magnetic sensor, Hall-effect sensor, or similar devices. The accessory may be connected to the modular medical device via a mechanical connection means, which may comprise a first portion configured to interlock with a second portion. The means for identifying the model indication of the connected accessory may comprise one or more magnetic identifier elements aligned with corresponding magnetic sensors. In operation, the magnetic sensors may be configured to detect a presence of a ferrous material, a direction of a polarity of a magnet, and/or a plurality of thresholds of magnetic strength of the aligned magnetic identifiers. Based on the detected properties of the identifier elements, a controller may determine an identification code or information required to effectively operate the modular medical device with a specific accessory connected.

In some aspects, the disclosure provides for an accessory detection apparatus for a modular medical device. The modular medical device includes a support portion and at least one support accessory in connection with the support portion via a connection interface. The connection interface is configured to support the at least one support accessory extending from the support portion. The accessory detection apparatus includes at least one detection device in connection with a first portion of the connection interface and at least one identifier element in connection with a second portion of the connection interface. The apparatus further includes a controller in communication with the at least one detection device. The controller is configured to process at least one signal communicated from the at least one detection device and detect an identifier of at least one support accessory in response to the at least one signal.

In some aspects of the disclosure, the disclosure may provide for one or more of the following features alone or in any combination:

the identifier comprises coded information identifying an operating configuration of the support accessory;

the at least one accessory is one of a plurality of interchangeable accessories configured to connect to the support portion via the connection interface;

the identifier element comprises at least one magnetic insert;

the at least one magnetic insert comprises a plurality of magnetic inserts, and the detection device is configured to detect a direction of polarity of each of the magnets;

the at least one magnetic insert comprises a plurality of magnetic inserts, and the controller is configured to detect the identifier by determining at least two conditions of each of the plurality of magnetic inserts;

the at least two conditions comprise a magnetic field strength and a magnetic field direction for each of the magnetic inserts;

the at least one detection device comprises a magnetic sensor configured to distinguish a magnetic strength of the at least one magnetic insert among a plurality of magnetic strength thresholds;

the at least one detection device comprises a plurality of magnetic sensors configured to detect a plurality of magnetic properties of each of the magnetic inserts indicating the identifier;

the support portion comprises a medical support table, and wherein the controller is further configured to control at least one operation of the medical support table in response to the identifier indicating at least one of a type and a proportion of the at least one support accessory;

the medical support table is an adjustable support table comprising at least one actuator configured to adjust a position of at least a portion of the at least one support accessory;

the controller is further configured to identify a range of motion of the at least one actuator for the at least one support accessory in connection with the medical support table based on the identifier; and/or the at least one support accessory comprises at least one of a leg support and a head support in connection with the medical support table via the connection interface.

In other aspects, the disclosure provides for a method for detecting an accessory for interchangeable connection with a modular medical device. The method includes providing the accessory comprising a mating connection to the modular medical device and detecting a polarity of at least one identifier element of the accessory in response to the connection of the accessory to the modular medical device. The method further includes interpreting an identifier signal corresponding to the polarity of the at least one identifier element that indicates an identifier of the accessory. The method further includes accessing a control configuration in a table or database based on the identifier and controlling a control parameter of the accessory in connection with the modular medical device in accordance with the control configuration.

In some aspects of the disclosure, the disclosure may provide for one or more of the following features or steps alone or in any combination:

detecting the polarity of the at least one identifier element comprises detecting a magnetic field presence and a magnetic field direction for a plurality of magnetic inserts;

detecting the polarity of the at least one identifier element comprises detecting a plurality of magnetic strength thresholds of the polarity of a plurality of magnetic inserts;

the control configuration identifies a range of motion of the accessory in connection with the modular medical device based on a kinematic relationship of the accessory to the modular medical device; and/or the control configuration identifies at least one of a rotational range of motion, a translational range of motion, rate of motion, a power setting, and a force limit of an actuator configured to adjust the accessory relative to the modular medical device.

In other aspects, the disclosure provides for an accessory detection apparatus for a modular medical device. The modular medical device includes a support portion and at least one support accessory in connection with the support portion via a connection interface. The connection interface is configured to support the at least one support accessory extending from the support portion. The apparatus includes at least one detection device in connection with a first portion of the connection interface and connected to the modular medical device and at least one identifier element in connection with a second portion of the connection interface and connected to the support accessory. The apparatus further comprises a controller in communication with the at least one detection device. The controller is configured to process at least one signal communicated from the at least one detection device and detect an identifier of at least one support accessory in response to the at least one signal. The identifier comprises coded information identifying an operating configuration of the support accessory. In response to the identifier, the controller access a control configuration in a table or database and sets a control parameter of the accessory in connection with the modular medical device in accordance with the control configuration. The controller configuration of the controller is configured to identify at least one of a rotational range of motion, a translational range of motion, rate of motion, a power setting, and a force limit of an actuator configured to adjust the support accessory relative to the modular medical device.

It will be understood by one having ordinary skill in the art that construction of the described device and other components is not limited to any specific material. Other exemplary embodiments of the device disclosed herein may be formed from a wide variety of materials unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the device as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present device. The exemplary structures and processes disclosed herein are for illustrative purposes and are not to be construed as limiting.

It is also to be understood that variations and modifications can be made on the aforementioned structures and methods without departing from the concepts of the present device, and further it is to be understood that such concepts are intended to be covered by the following claims unless these claims by their language expressly state otherwise.

The above description is considered that of the illustrated embodiments only. Modifications of the device will occur to those skilled in the art and to those who make or use the device. Therefore, it is understood that the embodiments shown in the drawings and described above are merely for illustrative purposes and not intended to limit the scope of the device, which is defined by the following claims as interpreted according to the principles of patent law, including the Doctrine of Equivalents.

What is claimed is:

1. An accessory detection apparatus for a modular medical device, the modular medical device comprising a support portion and at least one support accessory in connection with the support portion via a connection interface, wherein the connection interface is configured to support the at least one support accessory extending from the support portion, the apparatus comprising:

at least one detection device in connection with a first portion of the connection interface and connected to the modular medical device;

at least one identifier element in connection with a second portion of the connection interface and connected to the support accessory; and a controller in communication with the at least one detection device, wherein the controller is configured to:

process at least one signal communicated from the at least one detection device;

detect an identifier of at least one support accessory in response to the at least one signal, wherein the identifier comprises coded information identifying an operating configuration of the support accessory;

in response to the identifier, access a control configuration in a table or database; and set a control parameter of the accessory in connection with the modular medical device in accordance with the control configuration.

2. The accessory detection apparatus according to claim 1, wherein in response to the control configuration the controller is configured to identify at least one of a rotational range of motion, a translational range of motion, rate of motion, a power setting, and a force limit of an actuator configured to adjust the support accessory relative to the modular medical device.

3. An accessory detection apparatus for a modular medical device, the modular medical device comprising a support portion and at least one support accessory in connection with the support portion via a connection interface, wherein the connection interface is configured to support the at least one support accessory extending from the support portion, the apparatus comprising:

at least one detection device in connection with a first portion of the connection interface;

at least one identifier element in connection with a second portion of the connection interface, wherein the identifier element comprises a plurality of magnetic inserts and the detection device is configured to detect a direction of polarity of each of the magnetic inserts; and a controller in communication with the at least one detection device, wherein the controller is configured to:

process at least one signal communicated from the at least one detection device; and detect an identifier of at least one support accessory in response to the at least one signal.

4. The accessory detection apparatus according to claim 3, wherein the identifier comprises coded information identifying an operating configuration of the support accessory.

5. The accessory detection apparatus according to claim 3, wherein the at least one accessory is one of a plurality of interchangeable accessories configured to connect to the support portion via the connection interface.

6. The accessory detection apparatus according to claim 3, wherein the controller is configured to detect the identifier by determining at least two conditions of each of the plurality of magnetic inserts.

7. The accessory detection apparatus according to claim 6, wherein the at least two conditions comprise a magnetic field strength and a magnetic field direction for each of the magnetic inserts.

8. The accessory detection apparatus according to claim 6, wherein the at least one detection device comprises a magnetic sensor configured to distinguish a magnetic strength of the at least one magnetic insert among a plurality of magnetic strength thresholds.

9. The accessory detection apparatus according to claim 6, wherein the at least one detection device comprises a plurality of magnetic sensors configured to detect a plurality of magnetic properties of each of the magnetic inserts indicating the identifier.

10. The accessory detection apparatus according to claim 3, wherein the support portion comprises a medical support table, and wherein the controller is further configured to:

control at least one operation of the medical support table in response to the identifier indicating at least one of a type and a proportion of the at least one support accessory.

11. The accessory detection apparatus according to claim 10, wherein the medical support table is an adjustable support table comprising at least one actuator configured to adjust a position of at least a portion of the at least one support accessory.

12. The accessory detection apparatus according to claim 11, wherein the controller is further configured to:

identify a range of motion of the at least one actuator for the at least one support accessory in connection with the medical support table based on the identifier.

13. The accessory detection apparatus according to claim 10, wherein the at least one support accessory comprises at least one of a leg support and a head support in connection with the medical support table via the connection interface.

14. A method for detecting an accessory for interchangeable connection with a modular medical device, the method comprising:

providing the accessory comprising a mating connection to the modular medical device;

detecting a polarity of at least one identifier element of the accessory in response to the connection of the accessory to the modular medical device;

interpreting an identifier signal corresponding to the polarity of the at least one identifier element, wherein the identifier signal indicates an identifier of the accessory;

accessing a control configuration in a table or database based on the identifier; and controlling a control parameter of the accessory in connection with the modular medical device in accordance with the control configuration.

15. The method according to claim 14, wherein detecting the polarity of the at least one identifier element comprises detecting a magnetic field presence and a magnetic field direction for a plurality of magnetic inserts.

16. The method according to claim 14, wherein detecting the polarity of the at least one identifier element comprises detecting a plurality of magnetic strength thresholds of the polarity of a plurality of magnetic inserts.

17. The method according to claim 14, wherein the control configuration identifies a range of motion of the accessory in connection with the modular medical device based on a kinematic relationship of the accessory to the modular medical device.

18. The method according to claim 14, wherein the control configuration identifies at least one of a rotational range of motion, a translational range of motion, rate of motion, a power setting, and a force limit of an actuator configured to adjust the accessory relative to the modular medical device.

* * * * *